US006078768A

United States Patent [19]

Suzuki

[11] Patent Number: 6,078,768

[45] Date of Patent: Jun. 20, 2000

[54] DEVELOPING APPARATUS WHICH RECYCLES USED DEVELOPER BY EFFECTIVELY AND THOROUGHLY CONVEYING THE USED DEVELOPER FROM A DEVELOPING SLEEVE TO A DEVELOPER CONVEYING MEMBER

[75] Inventor: Keiichiro Suzuki, Hachioji, Japan

[73] Assignee: Konica Corporation, Tokyo, Japan

[21] Appl. No.: 09/179,312

[22] Filed: Oct. 27, 1998

[30] Foreign Application Priority Data

Oct. 31, 1997 [JP] Japan ..... 9-300532

[51] Int. Cl.[7] ..... G03G 15/08; G03G 15/09

[52] U.S. Cl. ..... 399/257; 399/252; 399/267

[58] Field of Search ..... 399/257, 264, 399/267, 273, 274, 275, 277, 281, 282, 283, 284, 285, 356; 430/101

[56] References Cited

U.S. PATENT DOCUMENTS

| | | | |
|---|---|---|---|
| 4,583,490 | 4/1986 | Kan et al. . | |
| 4,774,543 | 9/1988 | Yoshikawa et al. | 399/231 |
| 4,941,019 | 7/1990 | Honda et al. | 399/231 |
| 5,234,786 | 8/1993 | Ueda et al. | 430/101 |
| 5,434,351 | 7/1995 | Iwai et al. | 399/276 |
| 5,648,840 | 7/1997 | Ikunami et al. . | |

FOREIGN PATENT DOCUMENTS

| | | |
|---|---|---|
| 0 226 454 | 6/1987 | European Pat. Off. . |
| DE 34 30 190 | 3/1985 | Germany . |

OTHER PUBLICATIONS

Patent Abstracts of Japan, vol. 008, No. 259 (p–317), 28 Nov. 1984 and JP 59–131954 A (Fuji Xerox KK), 28 Jul. 1984.

Patent Abstracts of Japan, vol. 016, No. 532 (P–1448), 30 Oct. 1992 and JP 04–198972 A (Minolta Camera Co. Ltd.), 20 Jul. 1992.

*Primary Examiner*—Arthur T. Grimley
*Assistant Examiner*—Hoang Ngo
*Attorney, Agent, or Firm*—Frishauf, Holtz, Goodman, Langer & Chick, P.C.

[57] ABSTRACT

An apparatus for the development of electrostatic images includes a developer storing section, a developing sleeve, a first magnetic field generating member, a developer layer thickness regulator, a second magnetic field generating member and a developer conveying member. The second magnetic field generating member faces the developing sleeve and forms an attracting magnetic field to attract the carrier particles from the developing sleeve. The second magnetic field generating member, moreover, has a closer section located close to the developing sleeve and a farther section located far from the developing sleeve, the farther section being located downstream of the closer section with regard to the conveying direction. The strength of the attracting magnetic field at the farther section is stronger than that at the closer section so that the carrier particles are removed from the developing sleeve while the magnetic carrier particles is conveyed from the closer section to the farther section by the developing sleeve.

6 Claims, 8 Drawing Sheets

FIG. 6 ( a )
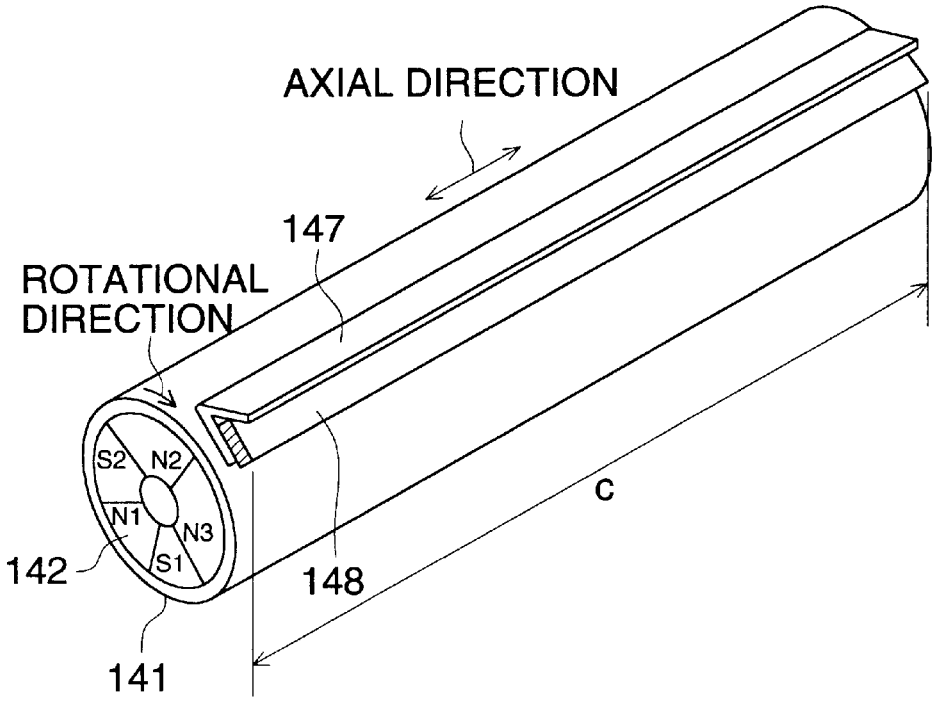
FIG. 6 ( b )
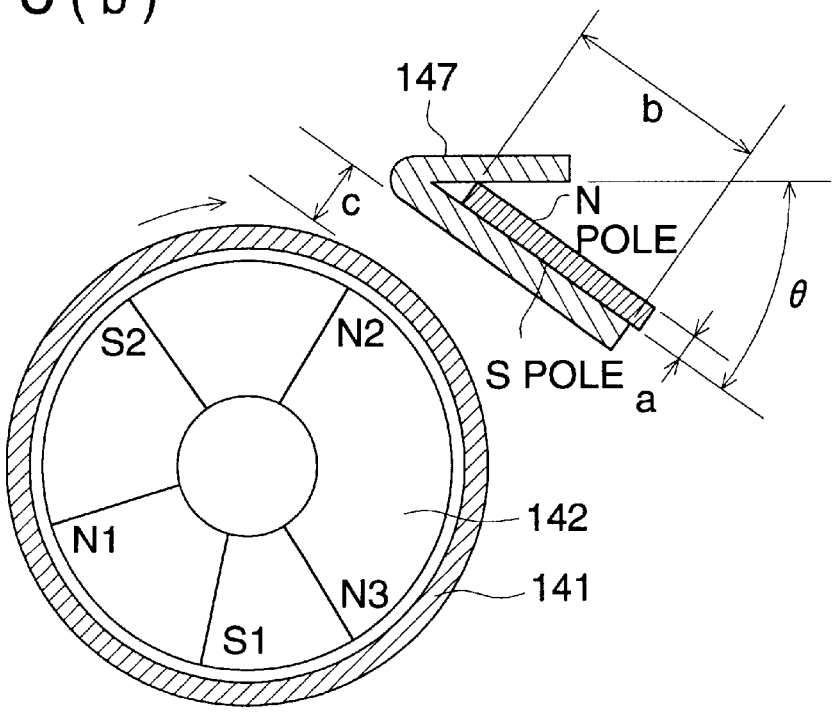

DEVELOPING APPARATUS WHICH RECYCLES USED DEVELOPER BY EFFECTIVELY AND THOROUGHLY CONVEYING THE USED DEVELOPER FROM A DEVELOPING SLEEVE TO A DEVELOPER CONVEYING MEMBER

BACKGROUND OF THE INVENTION

The present invention relates to a developing apparatus incorporated in an image forming device such as a copy machine, a printer, a facsimile, etc.

Regarding developing methods utilized for electrophotographic devices, it is well known that digital printers, digital copiers, etc. employ a reversal developing method, while conventional copiers, etc. employ a standard developing method. In the reversal developing method, after a latent electrostatic image is formed on an image bearing element (hereinafter, referred as a photoreceptor drum) through processes of electrostatic charging and exposure of light emitted from a light source such as lasers, LED (Light Emitting Diode), etc., a visible toner image is developed, in which toner is charged at the same polarity as the charged photoreceptor drum. For instance, when the photoreceptor drum is charged negatively, a visible toner image is formed on the photoreceptor drum by developing with toner also charged negatively in accordance with the pattern of electrostatic potential differences generated from the exposure of light. After development, a visible toner image formed on the photoreceptor drum is transferred to a copy medium by charging the copy medium at a polarity opposite to the toner, using corona discharge of a transfer apparatus. After transfer, the attraction force of the copy medium with the photoreceptor drum is decreased by dropping the electrostatic potential of the copy medium with AC or DC corona discharge, which is then peeled from the photoreceptor drum by its own weight.

In a conventional developing apparatus, a rotatable developing sleeve (developer bearing element) is located adjacent to a rotatable photoreceptor drum. Said developing sleeve, formed as a hollow cylinder, is mounted in a housing, wherein opening of the housing is located opposite the surface of said photoreceptor drum. A developing bias voltage of, for instance, −650V DC plus 2700V AC with a frequency of 8000 Hz is applied to said developing sleeve. A stationary magnet is mounted in the hollow interior of said developing sleeve, while a two component developer, composed of toner powder and magnetic particles (carrier), is attracted to the outer surface of said developing sleeve.

A developing apparatus is comprised of:

- a housing means to store a two-component developer composed of toner powder and carrier particles,
- a developing sleeve (or a developing roll) as a transfer means of the developer, wherein a magnetic roll, serving as a magnetic field generating means, is mounted
- a developer feeding roller (hereinafter, termed a feed roller)
- a developer layer regulating member to regulate the thickness of the developer layer formed on the surface of the developing sleeve at a predetermined value, and
- a developer agitating screw (hereinafter, referred to as an agitating screw).

The toner in said housing means, which is fed from a toner cartridge through a toner supply opening located at a top portion of said housing means, is mixed and agitated with the developer, stored in said housing means, by means of said agitating screw. As a result, toner of uniform density is supplied on the outer surface of said developing sleeve by means of said feed roller.

In the configuration of the developing apparatus mentioned above, since the toner is attracted to the image bearing element at the developing position, it is required that the residual toner and magnetic carrier should be recycled to the developing sleeve after scrubbing the used developer off the developing sleeve and agitating it with toner at a predetermined ratio.

For this purpose, there has been a technique that the developer is scraped off by physically contacting a scraper blade against the developing sleeve.

According to the above technique, since the scraper blade directly contacts the developing sleeve, a material with high abrasion resistance, such as stainless steel (SUS), etc., should be employed for the developing sleeve. An employment of SUS, however, has required relatively high cost, due to its difficult workability, etc.

Another technique is to remove the developer by means of a magnetic member arranged in a state of non-contacting with an aluminum alloy developing sleeve, which is relatively low in cost, set forth in Japanese Tokkai-sho No.60-91373, Tokkai-sho No.62-105174, Tokkai-hei No.6-194962, etc.

In this technique, a magnetic brush is formed in a space between the developing sleeve and the magnetic member, which is inductively magnetized by a magnet mounted stationary in the hollow interior of the developing sleeve. This magnetic brush acts as a blocking means to scrape the developer off the developing sleeve.

Although the above mentioned technique may be more or less effective to scrape the developer off the developing sleeve, some developer invariably passes through the magnetic brush due to the massive pressure of moving developer on the developing sleeve. Therefore, it may be virtually impossible for this technique to thoroughly remove said large amount of developer off the developing sleeve.

In addition, since the induced magnetic force of the magnetic member is no stronger than that of the magnet mounted stationary inside the developing sleeve, no magnetic force oriented to scrubbing the developer off the developing sleeve is generated. Moreover, some quantity of the developer removed from the developing sleeve directly moves around the developing region of the image bearing element. Such developer would recombine with the surface of the developing sleeve without passing the agitating process, resulting in developing defects.

As mentioned above, it is not effective for this purpose only to arrange the magnetic member in a state of non-contact with the developing sleeve. Especially, the conventional techniques are insufficient for a system where development is achieved by forming a thin layer of the developer on the developing sleeve.

SUMMARY OF THE INVENTION

To overcome the above mentioned drawbacks in the prior art, it is an objective of the present invention to provide a developing apparatus with which formation of high quality images is achieved, without occurrence of ghost images, developer deterioration nor abrasive scars on the developing sleeve.

The present invention relates to a developing apparatus, which achieves the above mentioned objectives, comprising;

- a developer storing section for storing two-component developer including toner particles and magnetic carrier particles;

a developing sleeve being a rotatable hollow cylinder;

a first magnetic field generating member provided inside the developing sleeve and having plural magnetic poles to attract the magnetic carrier particles on the developing sleeve so that the developing sleeve conveys the two-component developer with its rotation;

a developer layer thickness regulator to regulate the thickness of the two-component developer on the developing sleeve;

a second magnetic field generating member provided so as to face the developing sleeve and for forming attracting magnetic field to attract the carrier particles from the developing sleeve, wherein the second magnetic field generating member has a closer section located close to the developing sleeve and a farther section located far from the developing sleeve, the farther section is located downstream of the closer section with regard to the conveying direction, and the strength of the attracting magnetic field at the farther section is stronger than that at the closer section so that the carrier particles are removed from the developing sleeve while the magnetic carrier particles is conveyed from the closer section to the farther section by the developing sleeve; and a developer conveying member provided in the vicinity of the farther section of the second magnetic member and to convey the removed carrier particles to the developer storing section.

The present invention further relates to the above developing apparatus, wherein the first magnetic field generating means includes a first magnet and a second magnet both having the same polarity, the first magnet is located adjacent to the second magnet so that a repulsing magnetic field to remove the carrier particles from the developing sleeve is formed between the first magnet and the second magnet, the first magnet is located upstream of the second magnet in terms of the rotating direction of the developing sleeve, and the second magnetic field generating member is located adjacent to the first magnet.

BRIEF DESCRIPTION OF THE DRAWINGS

Other objectives and advantages of the present invention will become apparent upon reading the following detailed description and upon reference to the drawings in which:

FIG. 6(*a*) shows an arrangement of the developing sleeve, the magnetic roller, the magnetic member and the magnetic field generating element and FIG. 6(*b*) shows an enlarged lateral cross sectional view of FIG. 6(*a*);

DETAILED DESCRIPTION OF THE PREFERRED EMBODIMENT

Prior to describing the embodiments, the configuration and performance of the color printer which incorporates a plurality of the developing apparatus embodied in the present invention will be described in detail, referring to a lateral cross sectional view shown in FIG. 1.

In this color printer, as a color image forming device, color image formation is achieved by overlapping each color image which is sequentially formed on the image bearing element and transferring the completed image on a sheet of recording paper, one at a time. Subsequently, the recording paper is peeled off the image bearing element by means of a separating means.

Figure 1:
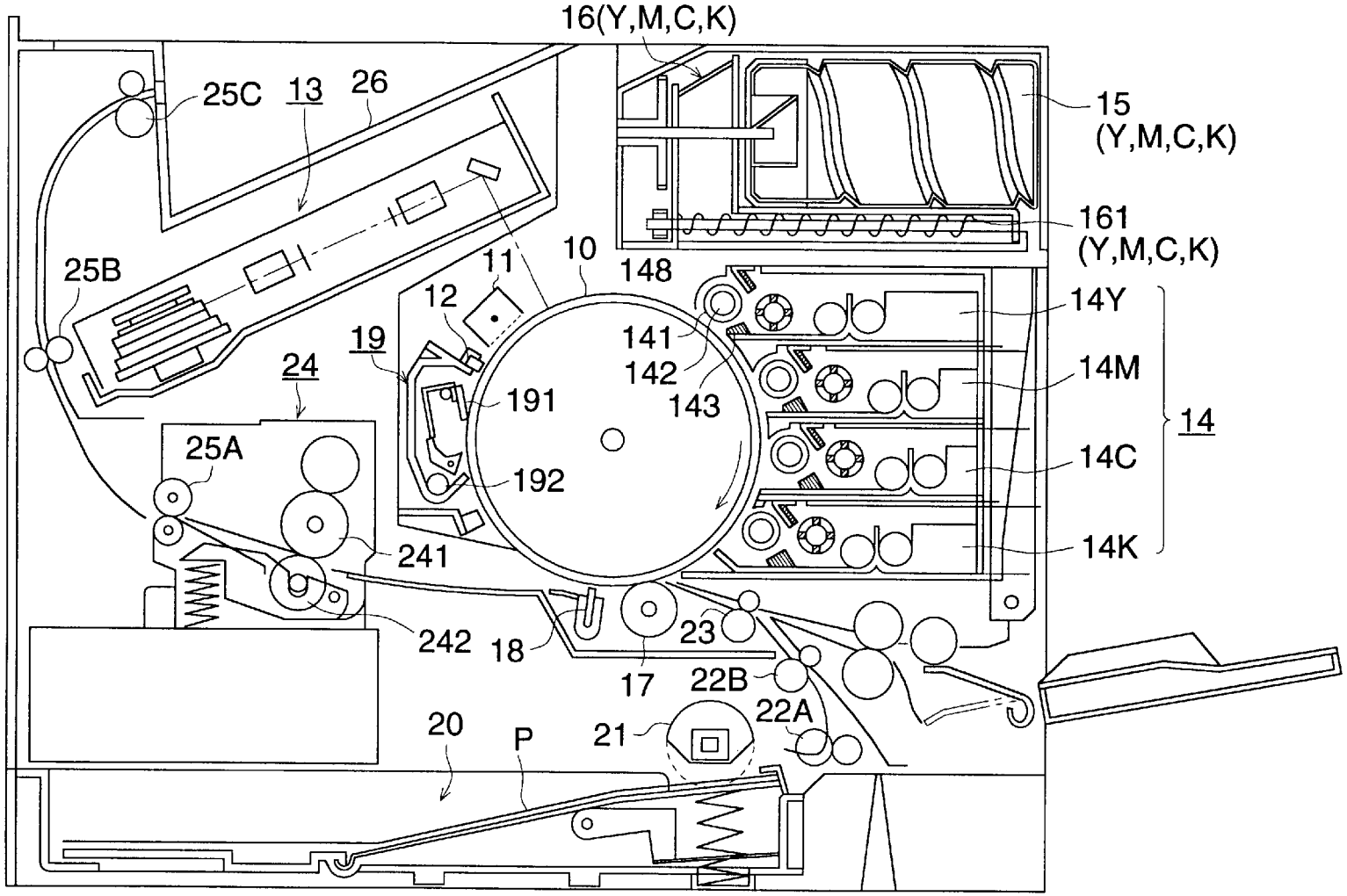
FIG. 1 shows a lateral cross sectional view of a color printer incorporating a plurality of the developing apparatus embodying the present invention.

In FIG. 1, grounded photoreceptor drum 10 as an image bearing element is rotationally driven in the direction shown by the arrow, whereon a coating layer of OPC (Organic Photo Conductor) is formed. Scorotron charger 11 provides the surface of photoreceptor drum 10 with a uniform charge of high electrical potential $V_H$, utilizing corona discharging action between a corona discharge wire and a screen grid, kept at grid voltage $V_G$. Preceding the charging operation by scorotron charger 11, the surface of photoreceptor drum 10 is uniformly pre-charged by irradiating light with PCL (Pre-Charging Lamp) comprised of LED (Light Emitting Diode), etc., in order to eliminate an image hysteresis on the surface of photoreceptor drum 10, which was formed during the previous printing process. The image hysteresis mentioned above is referred as a residual image pattern on the surface of photoreceptor drum 10, or as a memory of photo sensitive element, which remained from the preceding image forming processes of charging and image exposure.

After uniformly charging the surface of photoreceptor drum 10, image exposure is performed by image exposure means 13, based on image signals. Main scanning for the image formation is achieved by modulating a path of a laser beam emitted from laser diode (not shown) with a rotatable polygon mirror, a fθ lens and a cylindrical lens, which are mounted in image exposure means 13. The formation of a latent image is completed in association with the sub-scanning rotation of photoreceptor drum 10. In this embodiment, exposure of light is applied for the text portion of an original to form a reversal latent image so that the exposure potential $V_L$ is lower than the charge potential $V_H$.

Developing assembly 14 is mounted at the periphery of photoreceptor drum 10, comprising developing units 14Y, 14M, 14C, 14K, each of which contains a two-component developer such as yellow (Y), magenta (M), cyan (C), black (B), etc. respectively.

Initially, the first color image of yellow is developed by means of developing sleeve 141 which contains magnet roller 142 and rotates with the developer being absorbed on its surface. The developer comprises carriers of magnetite coated with insulating resin, toner made of polyester dispersed with pigments for each color, additives for charge controlling, silica, titanium oxide, etc. and is transferred to the developing region after regulating the thickness of the developer layer on developing sleeve 141 at a range of 100 to 600 $\mu$m by means of developer layer regulating member 143, described later.

In the developing region, the gap between developing sleeve 141 and photoreceptor drum 10 is set at a range of 0.5 to 1.0 mm which is larger than the thickness of the developer layer, wherein the overlapped bias voltage of DC voltage $V_{DC}$ and AC voltage $V_{AC}$ is applied. Since the DC bias voltage $V_{DC}$, the charge potential $V_H$ of photoreceptor drum 10 and the charge potential of toner have the same polarity, the visual image formation with toner (the reversal development) is achieved in such a manner that the toner eventually left from the carrier by the AC bias voltage $V_{AC}$ is attracted to regions charged with exposed potential $V_L$, which is lower than the DC bias voltage $V_{DC}$, instead of being attracted to regions charged with non-exposed potential $V_H$ which is higher than the DC bias voltage $V_{DC}$.

After the formation of the first color image, photoreceptor drum 10 is uniformly re-charged by means of scorotron charger 11, as the initial process of the second color image formation and then, a latent image is formed by means of image exposure means 13, based on the second image signal for the magenta portion of the image. In the formation of the second color image, however, the pre-charging process with PLC 12 is excluded though it is applied in the formation of the first color image, for fear that the abrupt change of the potential around the toner would cause scattering of the first color toner image.

The whole surface of photoreceptor drum 10 is uniformly re-charged with photoreceptor drum voltage $V_H$. In the blank regions of the first color image, the formation of the latent image and the development of the visual toner image are achieved in the same manner as in the formation of the first color image. While, in the filled regions of the first color image, a latent image with slightly higher potential $V_M$ than the potential $V_L$ of the first color image is formed under the influence of the shading effect by the toner already attached in the formation of the first color image and the charge existing in the toner itself. Therefore, the second color image of toner is developed in response to the potential difference between the DC bias voltage $V_{DC}$ and the potential $V_M$ mentioned above.

Regarding the third color image, cyan, and the fourth color image, black, the same image formation processes as those of the second color, magenta, are carried out. Finally, the visual image, superposed of the four colors of toner, is formed on the surface of photoreceptor drum 10.

To control feeding of each of developing units 14Y, 14M, 14C and 14K, with new toner of each color, a toner supplying unit comprises a plurality of detachable toner cartridges 15 (Y, M, C, K), toner storage means 16 (Y, M, C, K) and toner transfer means 161 (Y, M, C, K).

On the other hand, a copy medium (copy paper, etc.) drawn from paper supplying cassette 20 by means of crescent roller 21 is temporally stopped in the vicinity of the resist sensor after passing between intermediate conveyance rollers 22A and 22B. At the appropriate timing for transfer, a copy medium is fed to the transfer region by the rotating action of paired resist rollers 23.

In the transfer region, synchronizing with the transfer timing, a multi-color image of toner on photoreceptor drum 10 is transferred onto copy medium P, one at a time, by pressing copy medium P against photoreceptor drum 10 with transfer means 17 which comprises a transfer roller, etc. to apply a transfer voltage onto the surface of photoreceptor drum 10.

After the image transfer, copy medium P is discharged by means of separating means 18 such as a saw-toothed electrode, etc. to be peeled from photoreceptor drum 10. After separation, copy medium P is conveyed into fixing unit 24 to adhere the toner onto copy medium P with heat and pressure by means of heating roller (upper roller) 241 and pressing roller (lower roller) 242, and then, the finished copy medium is delivered to paper delivery tray 26 located outside of the device, passing between paired delivery rollers 25A, 25B and 25C. After the completion of the image transfer, transfer means 17 leaves the surface of photoreceptor drum 10, to standby for formation of the next toner image.

On the other hand, after the separation of copy medium P, the residual toner remaining on photoreceptor drum 10 is scraped off by pressing the surface with cleaning blade 191 mounted in cleaning unit 19. The next image formation will be started again through the pre-charging process by PLC 12 and the uniform charging process by scorotron charger 11, wherein immediately after cleaning the surface of photoreceptor drum 10, cleaning blade 191 retracts from the surface, and goes into the standby position. The residual toner, scraped into cleaning unit 19 by cleaning blade 191, is conveyed by conveyance screw 192 and stored in a residual toner storage (not shown).

Figure 2:
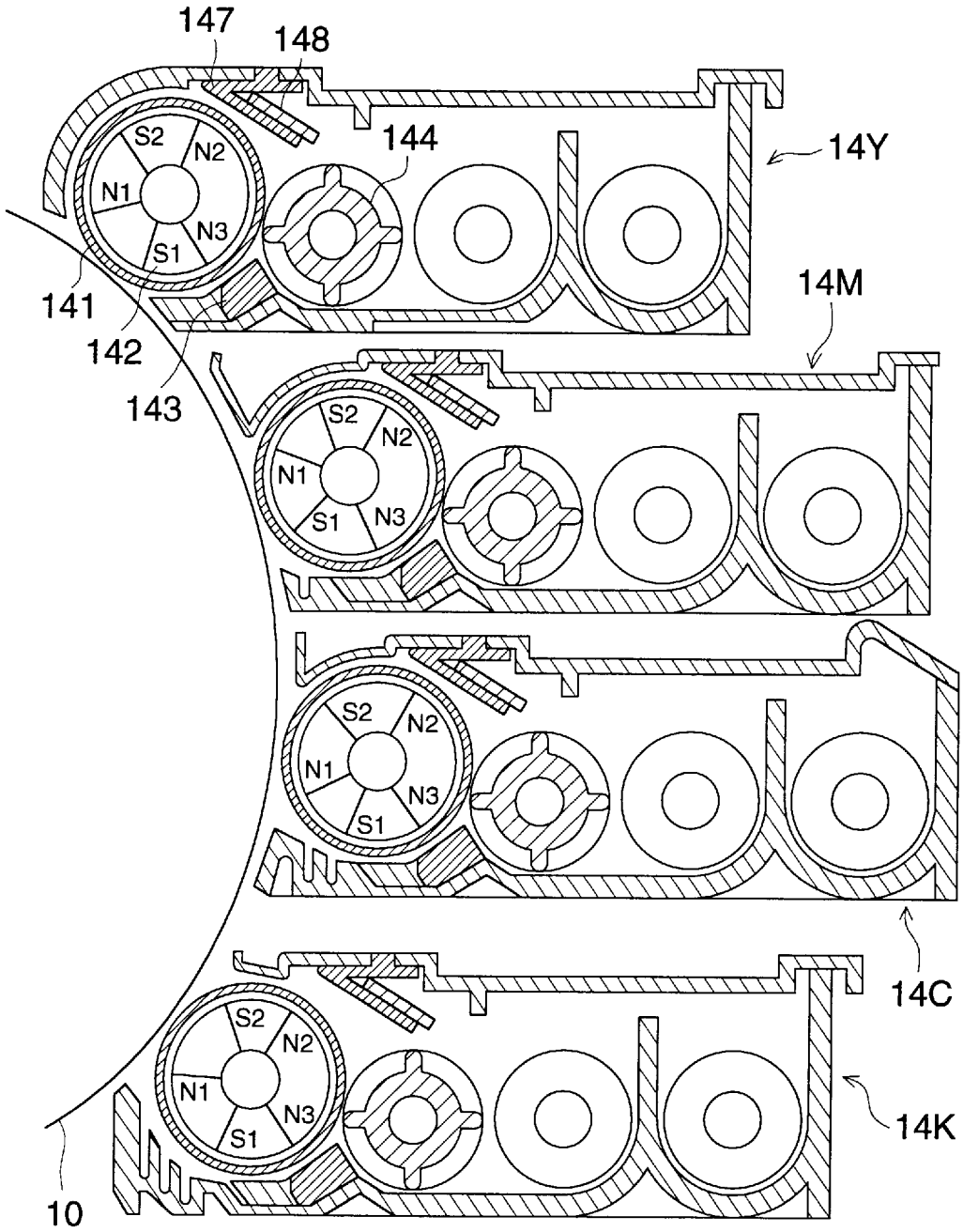
FIG. 2 shows a lateral cross sectional view of a plurality of the developing apparatus embodied the present invention.

FIG. 2 shows a lateral cross sectional view of the developing assembly comprised of a plurality of developing units 14Y, 14M, 14C, 14K, embodied in the present invention, wherein developing units 14Y, 14M, 14C, 14K, are arranged vertically above each other so that each developing sleeve 141 faces the surface of photoreceptor drum 10. Since developing units 14Y, 14M, 14C, 14K, have substantially the same configuration, only the function of developing unit 14Y will be described below, referring to it as developing unit 14.

Figure 3:
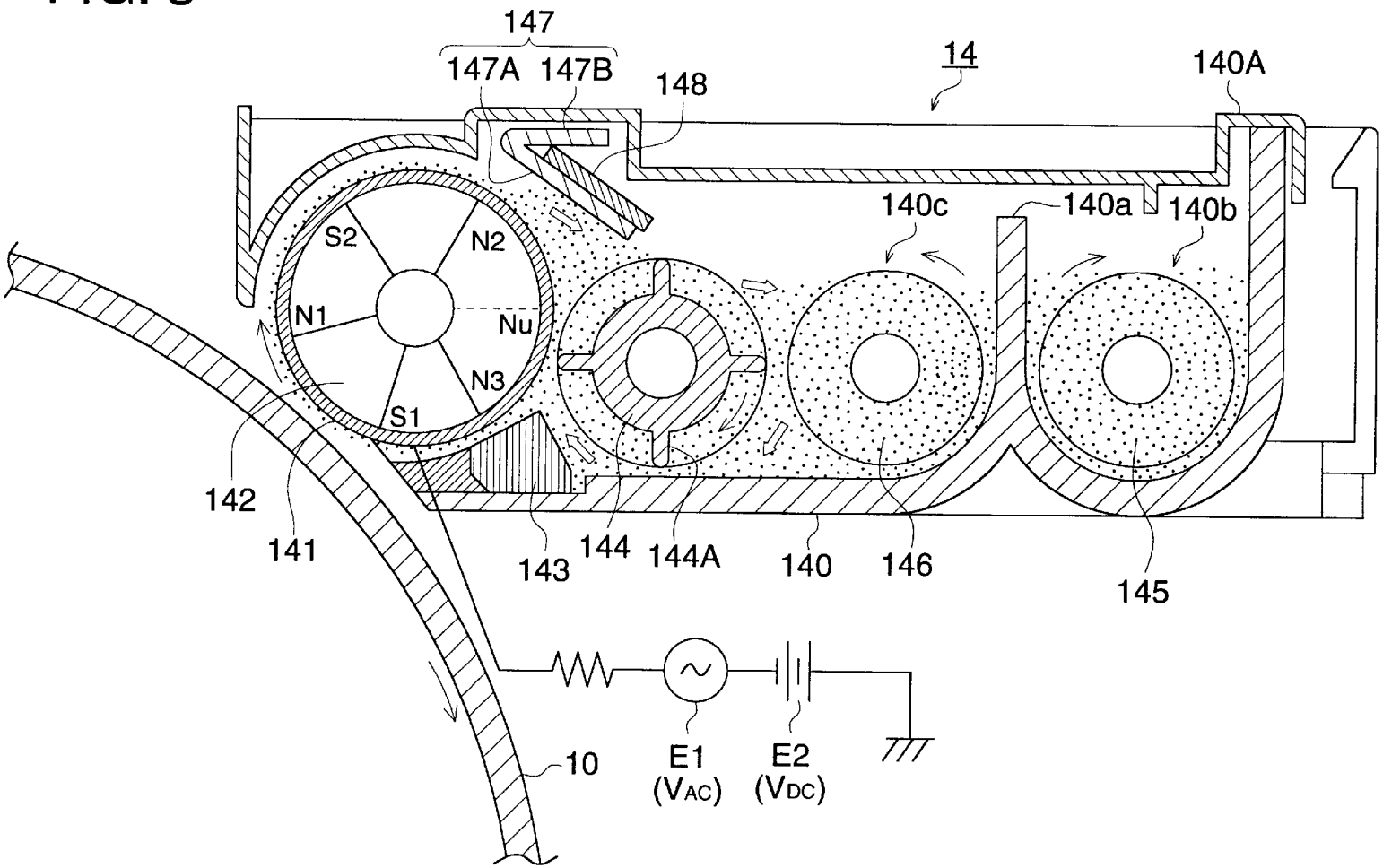
FIG. 3 shows a lateral cross sectional view of the developing apparatus embodied the present invention.
Figure 4:
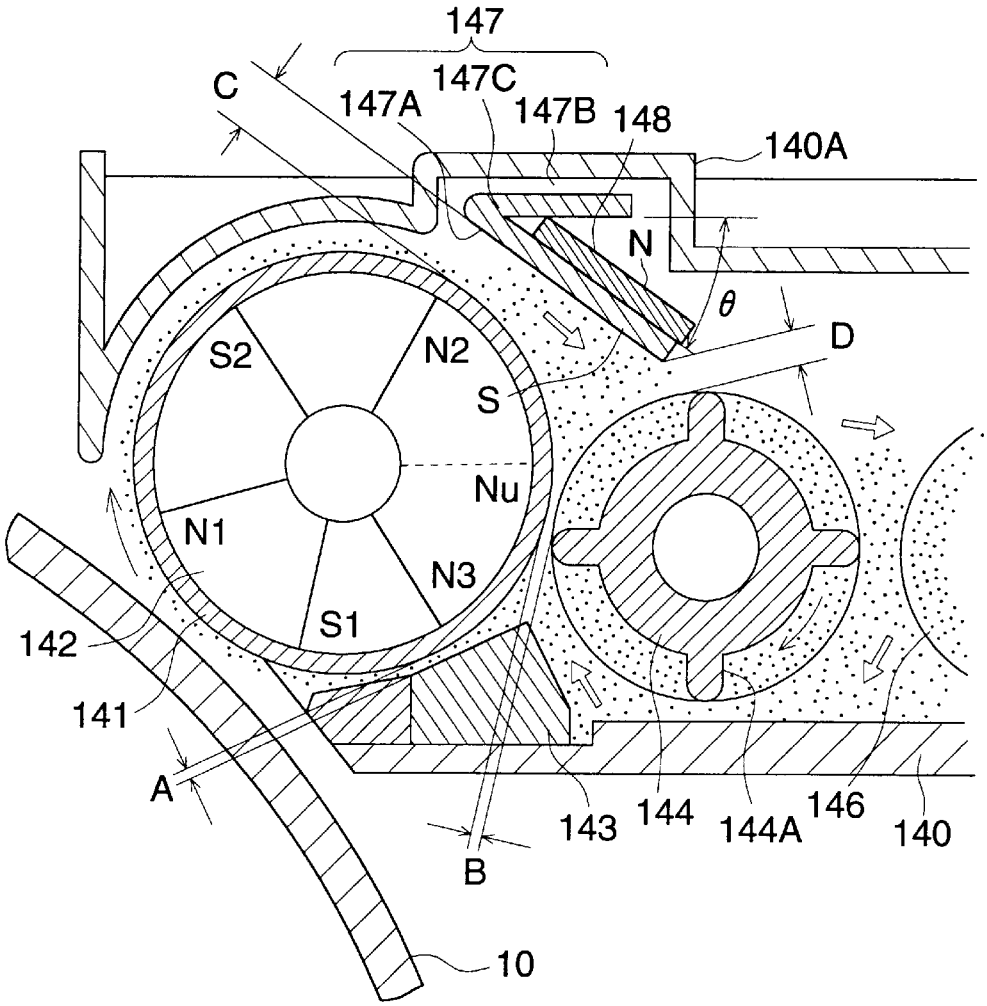
FIG. 4 shows an enlarged lateral cross sectional view of the developing apparatus embodied in the present invention, illustrating an arrangement of the developing sleeve and the peripheral members.

FIG. 3 shows a lateral cross sectional view of developing unit 14 embodied in the present invention. FIG. 4 shows an enlarged lateral cross sectional view of developing unit 14 embodied in the present invention, illustrating the arrangement of developing sleeve 141 and the peripheral members.

Specifically, FIG. 3 and FIG. 4 show:

- a developer housing (developer storage) 140 to store two-component developer composed of carrier and toner;
- a developing sleeve 141 which attracts the developer onto its surface, mounting a magnetic field generating means (magnetic roller) 142 comprised of stationary magnets in its hollow interior;
- a developer layer regulating member 143 to regulate the thickness of the developer layer formed on developing sleeve 141 at a predetermined value.

A plurality of magnetic poles N1, N2, N3, S1, S2 are alternatively arranged in magnetic roller 142 which is mounted stationary inside of developing sleeve 141. In such arrangement of magnetic poles, adjacent magnetic poles of N2 and N3 are arranged at the same polarity as each other to form a repulsive magnetic field which acts as a scraper means for removing the developer from developing sleeve 141, wherein the adjacent magnetic poles of N2 and N3 are referred as scraping magnetic poles. In addition, magnetic pole N3 is located opposite to a developer layer regulating member 143. While, in FIG. 3, E1 and E2 designate AC and DC voltage sources, respectively.

It is desirable that the outer diameter of developing sleeve 141 is in the range of $\phi 8$ to $\phi 60$ mm. If the diameter is less than $\phi 8$ mm, it is impractical to make magnetic roller 142 with, at least, five magnetic poles comprised of N1, S1, N2, S2, N3 which are necessary for high quality image formation.

In case the diameter of developing sleeve 141 is larger than $\phi 60$ mm, the size of the developing unit would also increase. Especially in a color printer incorporating a plurality of such developing units (for instance, developing units 14Y, 14M, 14C, 14K), the larger the developing units, the bigger the outer diameter of photoreceptor drum 10 is required. Therefore, it becomes difficult to realize a separating action of copy medium utilizing a curvature of the drum after image transfer and discharge operations. In addition, the whole scale of the color printer would also become larger, associating with large-sizing of developing unit 14 and photoreceptor drum 10.

As for the image formation device embodied in the present invention, the revised version of Konica KL-2010 Color Printer (manufactured by Konica Corp.) has been employed, wherein the outer diameter of developing sleeve 141 is ϕ18 mm and that of photoreceptor drum 10 is ϕ100 mm.

A developer layer regulating member 143 is comprised of magnetic members, such as stainless steel, iron, etc., and its surface located opposite developing sleeve 141 faces magnetic pole N3, while a minimum gap is set to a small predetermined value A (for instance, A=0.35 mm). Consequently, a wedge type space is created along a portion of the surface of developing sleeve 141, gradually widening the minimum gap to the upstream of the rotational direction.

Developer feeding roller (hereinafter, referred to it as a paddle wheel) 144 formed with a plurality of paddles 144A feeds developing sleeve 141 with the recycled developer, as well as feeding agitating screw 146 with the used developer scraped off the surface of developing sleeve 141. The gap between the rotational tip locus of paddles 144A and the outer surface of developing sleeve 141 is set to a small predetermined value B (for instance, B=0.5 mm) as shown in FIG. 4.

In FIG. 3, the rotational direction of each agitating screws (developer agitating screw) 145 and 146 is designated by the arrow and the flow direction of the developer is designated by the outlined arrow. Agitating screws 145 and 146, arranged in parallel, are mounted in first agitating chamber 140*b* and second agitating chamber 140*c* respectively and are rotated in directions opposite from each other, wherein the two chambers are divided by wall 140*a* protruding straight-up from the bottom of developer housing 140, while the tops of the first and the second agitating chambers 140*b* and 140*c* are closed with top cover 140A.

The toner conveyed from toner cartridge 15 through toner storage means 16 and toner conveyance means 161 is supplied to the first agitating chamber 140*b* through a toner supply opening (not shown) located at top cover 140A.

Figure 5:
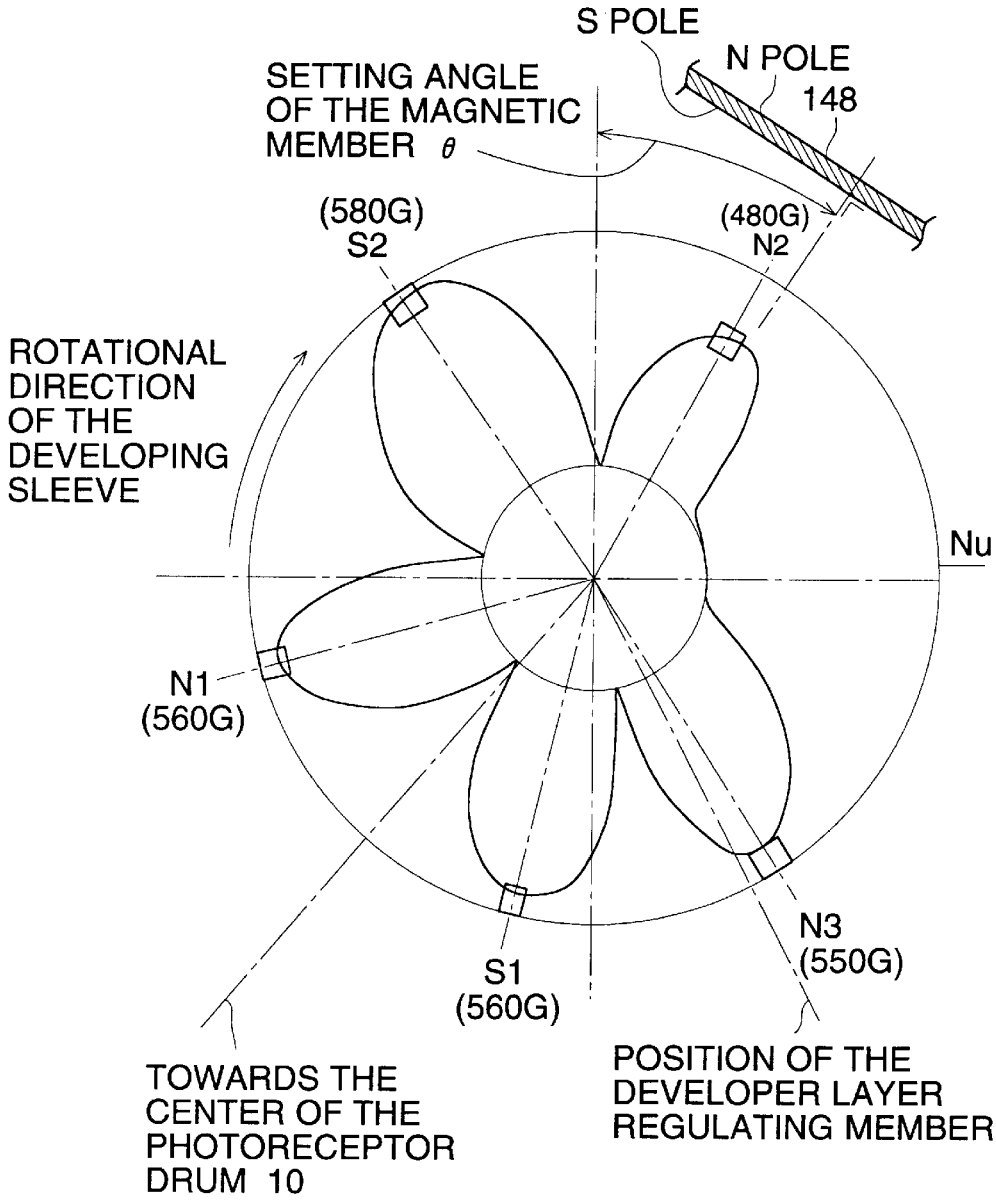
FIG. 5 shows the distribution of the magnetic field strength generated by the magnetic roller.

FIG. 5 shows the strength distribution of magnetic field generated by magnetic roller 142. When developing sleeve 141, which surrounds magnetic roller 142, made of a non-magnetic material, rotates in the direction shown by the arrow, it is actually observed that a region attracting a little developer was created on the surface of developing sleeve 141 by scraping the developer off the surface, ranging from the vicinity of magnetic pole N3 to the vicinity of magnetic pole N2 toward the upstream direction of its rotation, due to the repulsive magnetic field generated by magnetic poles N2 and N3. It is impossible, however, to completely remove the developer from the surface of developing sleeve 141 only with the repulsive magnetic field generated by scraping magnetic poles N2 and Nb 3.

In the developing unit embodied in the present invention, magnetic field generating member 148, which generates a magnetic field with characteristics different from those of magnetic poles N2 and N3, is mounted at a fixed location adjacent to developing sleeve 141 near magnetic pole N2 upstream of said repulsive magnetic field. In other words, the pole of magnetic field generating member 148 is located opposite the vicinity of magnetic pole N2 to generate an attracting magnetic field. Magnetic member 147 firmly holds magnetic field generating member 148 at a fixed position near the inner side of top cover 140A, as well as guiding the used developer from developing sleeve 141 towards paddle wheel 144. V shaped magnetic member 147, made of magnetic stainless steel (SUS430, etc.) or iron, is comprised of developer guiding surface 147A facing developing sleeve 141, attaching portion 147B which is fixed to top cover 140A and bent portion 147C. The angle of inclination θ (referred as a setting angle of magnetic member) at bent portion 147C is set to, for instance, θ=35°.

Developer guiding surface 147A faces the vicinity of magnetic pole N2, while a minimum gap, between developer guiding surface 147A and developing sleeve 141, is set to a predetermined value C (for instance, C=3 mm). Consequently, a wedge type space is created along the surface of developing sleeve 141, gradually widening the gap downstream in the rotational direction. The tip of developer guiding surface 147A is located near said rotational tip locus of paddles 144A, while the gap between them is set to a predetermined value D (for instance, D≈2 mm).

Magnetic field generating member 148, made of a permanent magnet, etc. is fixed on the back of developer guiding surface 147A by means of a double-sided adhesive tape. Since magnetic field generating member 148 does not exist in the bent portion of magnetic member 147, as shown in FIG. 2 and FIG. 3, the magnetic field strength generated by magnetic field generating member 148 is attenuated upstream of developer guiding surface 147A. Therefore, the used developer on developing sleeve 141 would smoothly flow along developer guiding surface 147A without being attracted by the attenuated magnetic field downstream of the rotational direction. Thus, a developer miss-flow, caused by a developer jamming in the vicinity of attaching portion 147B, is prevented.

As for magnetic field generating member 148, employment of a rubberized magnet, BQC14, which belongs to a ferrite group and is manufactured by TDK Co., showed excellent effects in the above mentioned application. Said BQC14 is made of an NBR gum mulled with a strontium ferrite powder. Its characteristics as a material are shown in the following.

Residual Flux Density (Br): 230–250 [mT]

Coercive Force: $H_{cB}$ 163–195 [kA/m]

Intrinsic Coercive Force: $H_{cJ}$ 279–358 [kA/m]

Maximum Energy Product (BH)max: 10.3–11.9 [kJ/m$^3$]

In addition to the BQC14 mentioned above, magnetic materials, such as rubber magnets of ferrite groups (BQJ05, BQA14, BQE14, BQK12), cobalt magnets of neodymium/iron/boron rare earth metal group (NEOREC magnet series), cobalt magnets of rare earth metal group (REC magnet series), compound magnets of wet anisotropy ferrite magnetic material group (FB series), etc. are available, which produce substantially the same effect. Although all of the magnetic materials listed above are manufactured by TDK Co., the scope of the available magnetic materials is not limited within them as far as an employed material satisfies the required values of residual flux density, coercive force and maximum energy product.

FIG. 6(*a*) shows an arrangement of developing sleeve 141, magnet roller 142, magnetic member 147 and magnetic field generating member 148, while FIG. 6(*b*) shows an enlarged lateral cross sectional view of FIG. 6(*a*).

The dimensions of magnetic field generating member 148, made of BQC14, are shown in the following:

Thickness a (length between poles N and S)=1 mm

Height b=4 mm

Width c (length parallel to the axial direction of developing sleeve 141)=300 mm The two-component developer, agitated by agitating screws 145 and 146, is conveyed into the gap between the slanted surface of developer layer regulating member 143 and the outer surface of developing sleeve 141, by means of paddles 144A of paddle wheel 144, which rotates clockwise as shown in FIG. 3. The developing sleeve 141 attracts the two-component developer in the vicinity of the gap by means of the magnetic force emitted from magnetic roller 142, and conveys it to the developing region where the surface of photoreceptor drum 10 is located opposite the surface of developing sleeve 141, while the thickness of the developer layer on developing sleeve 141 is regulated within a range of 100 to 600 $\mu$m by means of minimum gap A.

After development, the developer attracted on the surface of developing sleeve 141 passes through minimum gap C located between magnetic member 147 and developing sleeve 141. Upstream of rotational direction of developing sleeve 141, the attractive force for the developer is relatively weak in the vicinity of magnetic pole N2 where magnetic field generating member 148 does not exist, while the strength of the magnetic field generated under magnetic field generating member 148 increases downstream of the rotational direction of developing sleeve 141.

In gap C, after the developer is scraped off developing sleeve 141 by scraping magnetic poles N2 and N3, magnetic field generating member 148 attracts the scraped developer towards the upper region of paddle wheel 144 so as to prevent its scattering onto developing sleeve 141.

Since the developer is gradually attracted by magnetic field generating member 148 according as the developer moves toward the downstream direction of rotational developing sleeve 141, it becomes possible to scrape the developer off developing sleeve 141. Therefore, it is not only possible to remove a sufficient amount of the developer from developing sleeve 141 but also possible to play an effective role even in a system in which the developing process is carried out by forming a thin layer of the developer on developing sleeve 141.

The developer scraped off developing sleeve 141 through the above mentioned processes moves downward diagonally along developer guiding surface 147A being magnetically attracted by it and drops onto the rotational paddle wheel 144 in the vicinity of gap D located at the end tip of developer guiding surface 147A.

Then, the developer scraped off developing sleeve 141 is engaged by rotating paddles 144A and conveyed to the rotating agitational screw 146 to be agitated and recycled. The end tip of developer guiding surface 147A is located adjacent to and just above the rotational tip locus of paddles 144A to form gap D.

Since gap B between the tip locus of paddles 144A and the outer surface of developing sleeve 141 is set to an optimally small value and paddles 144A rotate at gap B in the direction so as to scoop up developer scraped off developing sleeve 141, almost all of the developer dropped from developer guiding surface 147A is engaged by paddles 144A and conveyed to agitating screw 146 without passing up through gap B.

Figure 7:
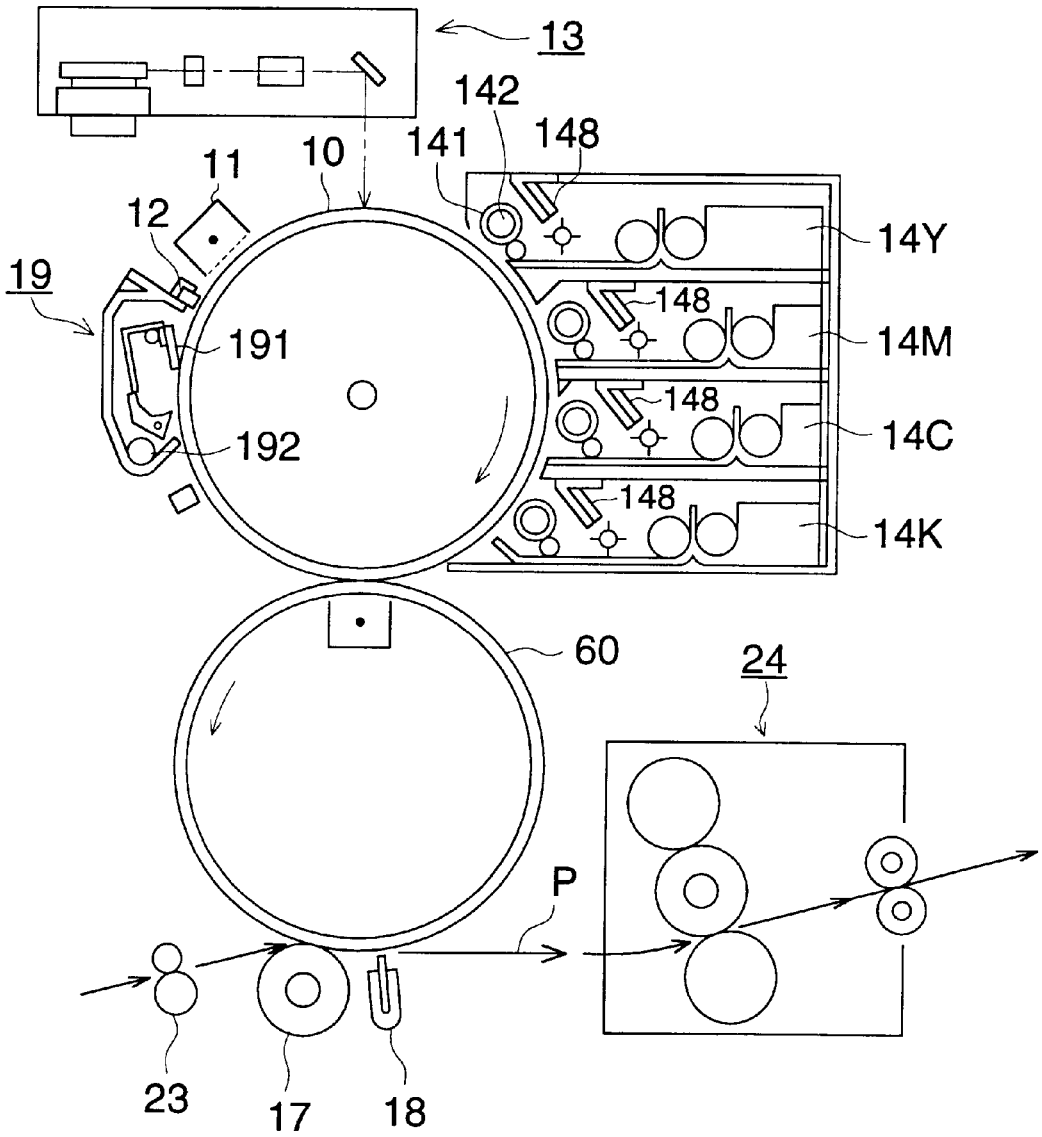
FIG. 7 shows a lateral cross sectional configuration of the color image forming device incorporating the intermediate transfer drum and the developing apparatus embodied in the present invention.

FIG. 7 shows a lateral cross sectional configuration of the color image forming device incorporating intermediate transfer drum 60 as an image bearing element. In this embodiment, a latent image formed on the surface of rotating photoreceptor drum 10 is developed by means of developing unit 14Y, which incorporates developing sleeve 141, magnetic roller 142 comprised of scraping magnetic poles, and magnetic member 148, to form a toner image, of color Y, to be transferred onto intermediate transfer drum 60. As well as the above, a latent image formed on the surface of photoreceptor drum 10 is developed by means of developing unit 14M to form a toner image, of color M, to be transferred to intermediate transfer drum 60. Through the same process, after development, a toner image of color C and a toner image of color K are sequentially transferred onto intermediate transfer drum 60 from photoreceptor drum 10. A multi-color toner image (superposed of Y, M, C and K images) is further transferred onto copy medium P at the point where transfer roller 17 contacts intermediate transfer drum 60 and said multi-color toner image on copy medium P is fixed by means of fixing unit 24 after a separating operation by means of separating means 18.

Figure 8:
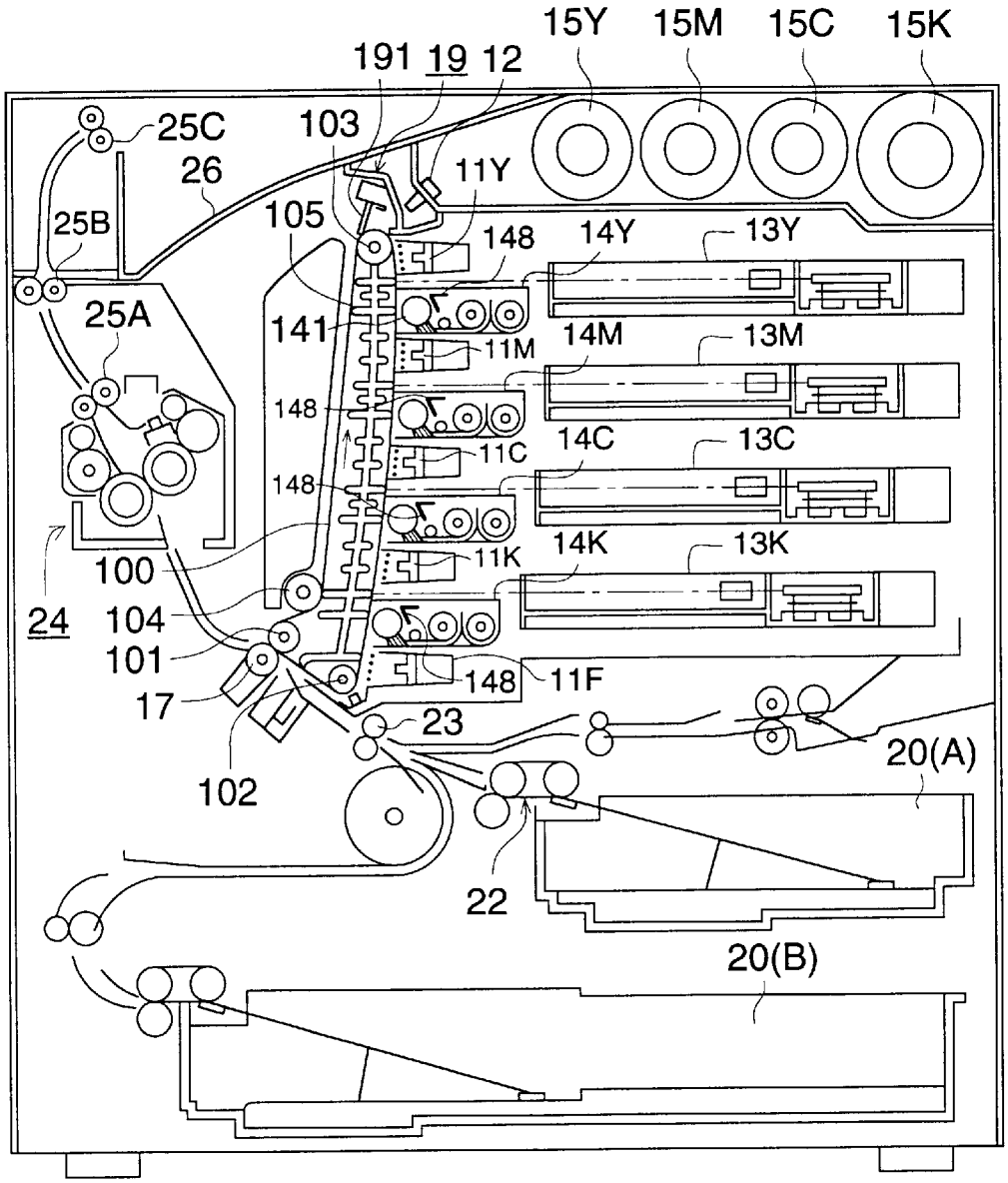
FIG. 8 shows a lateral cross sectional configuration of another embodiment of the color image forming device embodied in the present invention.

FIG. 8 shows a lateral cross sectional configuration of another embodiment of the color image forming device incorporating developing units embodying the present invention.

In FIG. 8, the same functional portions as illustrated in FIG. 1 will be given the same nomenclature and only the points which are different from the previous embodiments will be described in the following description.

In this color image forming device, shown as well in FIG. 1, a plurality of image forming units (four units being shown) comprised of charging means 11 (Y, M, C, K), image exposure means 13 (Y, M, C, K) as an external exposing type and developing means 14 (Y, M, C, K) are arranged at the periphery of an image bearing element, wherein a flexible and closed loop photo sensitive belt 100 (hereinafter referred to as photoreceptor belt 100) and an optical unit of scanning laser beams are employed for the image bearing element, and image exposure means 13, respectively.

Photoreceptor belt 100 is threaded on driving roller 101 and driven rollers 102, 103, and is maintained in a taut state by means of tensioning roller 104, being rotated clockwise as designated by the arrow, while partially contacting backup member 105. The purpose of backup member 105 is to position the surface for the developing regions of developing sleeves 141 (Y, M, C, K) and focal planes of image exposure means 13 (Y, M, C, K).

Four units of image forming means, comprised of charging means 11 (Y, M, C, K), image exposure means 13 (Y, M, C, K) and developing means 14 (Y, M, C, K), are arranged at the periphery of photoreceptor belt 100.

At the initial step of image formation, photoreceptor belt 100 is rotated by driving roller 101 linked to a driving motor and is uniformly charged by means of scorotron charger 11Y in a charging operation. At the next step, a latent image of color Y is formed on the surface of photoreceptor belt 100 by means of image exposure means 13Y in an exposing operation, and by the belt rotation in a sub-scanning action, based on image signals of color Y as the first color. After said exposing operation, while photoreceptor belt 100 rotates, a reversal development of the latent image is carried out to form a toner image of yellow (Y) by means of developing unit 14Y in a state of non-contact with the developer adhered onto developing sleeve 141Y.

Superposed on the yellow (Y) toner image, photoreceptor belt 100 is uniformly re-charged by means of scorotron charger 11M in a charging operation. A latent image of color M is formed on the surface of photoreceptor belt 100 by means of image exposure means 13M in an exposing operation, based on image signals of color M as the second color. After said exposing operation, reversal development of a latent image is carried out to form a toner image of magenta (M), superposed on the yellow (Y) toner image, by means of developing unit 14M in a state of non-contact with the developer adhered onto developing sleeve 141Y.

Through the same process mentioned above, a toner image of cyan (C) is superposed on the toner images formed previously, by means of scorotron charger 11C, image exposure means 13C and developing unit 14C, as is also the case for the black (B) toner image, by means of scorotron charger 11B, image exposure means 13B and developing unit 14B. As a result, a full-color toner image is formed on the surface of photoreceptor belt 100 within a period of its single revolution.

During the developing operation utilizing developing units 14Y, 14M, 14C, 14B, either a DC bias voltage or a DC plus AC bias voltage is applied to developing sleeves 141Y, 141M, 141C, 141B each of which bears a single- or a double-component developer on its surface, while the polarity of the DC bias voltage carries the same charging polarity of photoreceptor belt 100, the conductive layer of which is grounded. Under the above conditions, the non-contacting and reversal development is carried out by attracting the toner from the surface of developing sleeve 141 to the region of a latent image formed on photoreceptor belt 100.

After normalizing the potential of attached toner by means of scorotron charger 11F, the discharge operation for the toner image of full-color, formed on the surface of photoreceptor belt 100, is carried out by means of a pre-transfer exposing apparatus. Then, the full-color toner image is transferred to a copy medium by means of transfer roller 17 located at the transfer position opposite the lower side of driving roller 101. The copy medium is fed to the transfer position by paired resist rollers 23, synchronized with the movement of the toner image to be transferred, after being drawn from paper supply cassettes 20(A) as a automatic paper supply apparatus, or 20(B) which serves as a cassette for manually loading of non-standard copy medium.

The copy medium, carrying the transferred toner image, is peeled off the surface of photoreceptor belt 100 which is clung along the curvature of driving roller 101, and is conveyed into fixing unit 24 which fuses and fixes the toner on the copy medium with heat and pressure applied by fixing rollers in fixing unit 24. Passing between paired delivery rollers 25A, 25B and 25C, the finished copy medium is delivered to delivery tray 26 located at the upper area of the device in such a manner that the toner image faces down.

After the separation of the copy medium, any residual toner remaining on photoreceptor belt 100 is scraped off by contact with cleaning blade 191 mounted in cleaning unit 19. After said cleaning operation, the next image formation is started again with a process of pre-charging by PLC 12 to eliminate any hysteresis of the previous image on photoreceptor belt 100, or the device enters a standby mode.

As shown in FIG. 2, magnetic poles N1, N2, N3, S1, S2 are mounted in each developing sleeve 141 of developing units 14 (Y, M, C, K). In this arrangement, adjacent magnetic poles are arranged in the same polarity next to each other to form a repulsive magnetic field for scraping the developer off developing sleeve 141. Meanwhile, magnetic field generating member 148 is mounted in the vicinity of scraping magnetic poles N2 and N3 in a non-contact state to remove the developer from developing sleeve 141 and to eliminate any hysteresis of the previous image on developing sleeve 141 by generating an attracting magnetic field with a polarity different from that of scraping magnetic poles N2 and N3. The removed developer is conveyed to agitating screw 146, by rotation of paddle wheel 144.

The scope of the present invention is not limited to only a full-color image forming device incorporating a plurality of the developing apparatus embodied in the present invention. It is also possible to embody the present invention in an application of a monochrome image forming device which requires only one developing apparatus.

According to the developing apparatus embodied in the present invention, since a magnetic member, with a polarity different from those of the scraping magnetic poles, is located opposite them and in a state of non-contact with them to generate a strong attracting magnetic field directed outwards, the presence of ghost image is drastically reduced. According to the toner scraping technique embodied in the present invention, since the magnetic field for scraping toner is created by mounting the magnetic member in a state of non-contact with the developing sleeve, the drawbacks of the prior art due to the direct contact of the scraper blade with the developing sleeve, such as slippage of developer through the gap between the developing sleeve and the scraper blade, deterioration of developer caused by a scraping abrasion and damage to the developing sleeve, are successfully overcome. In addition, in an image forming device embodied in the present invention, a charge potential and an image intensity will not be decreased, even during continuous printing of many copies.

Moreover, according to the present invention, since the magnetic field generating member for removing, attracting and conveying the developer from the developing sleeve is mounted in a state of non-contact with the developing sleeve, it becomes possible to change the material of a substantial member, which forms the outer surface of the developing sleeve, from stainless steel (SUS) to an aluminum alloy. This will result in reduction of manufacturing cost and reduction of its weight.

What is claimed is:

1. A developing apparatus for developing an electrostatic latent image so as to form a toner image on a photoreceptor element, comprising:

a developer storing section which stores two-component developer including toner particles and magnetic carrier particles;

a developing sleeve arranged opposite the photoreceptor element so as to provide a developing region therebetween, said developing sleeve comprising a hollow cylinder and being rotatable in a direction such that the two-component developer is conveyed upward at the developing region;

a first magnetic field generator provided inside the developing sleeve and having plural magnetic poles to attract the magnetic carrier particles on the developing sleeve so as to convey the two-component developer when the developing sleeve is rotated, wherein said plural magnetic poles include a first magnetic pole and a second magnetic pole which both have a same polarity and which are arranged side by side so as to generate a repulsing magnetic field to remove the carrier particles from the developing sleeve;

a developer layer thickness regulator which regulates a thickness of the two-component developer on the developing sleeve;

a second magnetic field generator which generates an attracting magnetic field for attracting the carrier particles from the developing sleeve, said second magnetic field generator having a developer guiding surface which is located above an upper side of the developing sleeve in a vicinity of the repulsing magnetic field, and said developer guiding surface having a closer section and a farther section, said farther section being located farther from the developing sleeve than the closer section and being located downstream of the closer section with respect to a conveying direction of the carrier particles, and a strength of the attracting magnetic field at the farther section being stronger than that at the closer section so that the carrier particles are attracted to the closer section and conveyed to the farther section along the developer guiding surface; and a developer conveying member, provided in a vicinity of the farther section of the developer guiding surface, for conveying the removed carrier particles to the developer storing section.

2. The developing apparatus of claim 1, wherein the second magnetic field generator has a flat surface facing the developing sleeve, and the closer section and the farther section are continued on the flat surface.

3. The developing apparatus of claim 1, wherein the second magnetic field generator comprises a magnetic member and a magnet attached to the magnetic member.

4. The developing apparatus of claim 3, wherein the magnetic member comprises a plate having a bent-over portion.

5. The developing apparatus of claim 1, wherein the developer conveyance member supplies the developer from the developer storing section to the developing sleeve.

6. The developing apparatus of claim 5, wherein the developer conveyance member comprises a developer supplying roller which agitates and supplies the developer.

* * * * *